US009749747B1

(12) United States Patent
Kriegel et al.

(10) Patent No.: US 9,749,747 B1
(45) Date of Patent: Aug. 29, 2017

(54) EFFICIENT SYSTEM AND METHOD FOR GENERATING AN AUDIO BEACON

(71) Applicant: Apple Inc., Cupertino, CA (US)

(72) Inventors: Adam E. Kriegel, Mountain View, CA (US); Afrooz Family, Emerald Hills, CA (US); Richard M. Powell, Mountain View, CA (US); Jay S. Coggin, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/933,990

(22) Filed: Nov. 5, 2015

Related U.S. Application Data

(60) Provisional application No. 62/105,671, filed on Jan. 20, 2015.

(51) Int. Cl.
*H04R 5/02* (2006.01)
*H04S 3/02* (2006.01)

(52) U.S. Cl.
CPC *H04R 5/02* (2013.01); *H04S 3/02* (2013.01)

(58) Field of Classification Search
CPC H04R 29/002; H04R 29/005; H04R 2201/40; H04R 2201/01; H04R 2201/403; H04R 2201/405; H04R 2203/12; H04R 5/02; H04S 3/02
USPC ..... 381/56, 58, 61, 124, 303
See application file for complete search history.

(56) References Cited

U.S. PATENT DOCUMENTS

2004/0151325 A1* 8/2004 Hooley ..... F41H 13/0081 381/18
2005/0207592 A1* 9/2005 Sporer ..... H04S 7/30 381/94.2
2008/0267413 A1* 10/2008 Faller ..... H04S 3/002 381/1
2013/0223658 A1* 8/2013 Betlehem ..... H04S 3/002 381/307

* cited by examiner

*Primary Examiner* — William A Jerez Lora
(74) *Attorney, Agent, or Firm* — Blakely Sokoloff Taylor & Zafman LLP

(57) ABSTRACT

An audio emission device and an audio capture device that may respectively emit and capture sound within a listening area is described. The audio emission device may produce one or more primary audio beams in the listening area. Each of the primary audio beams may be formed by weighting a set of modal beam patterns. Separate orthogonal test signals may be injected into each modal beam pattern. Based on these separate orthogonal test signals, the individual modal beam patterns may be extracted from a detected sound signal, produced by the audio capture device, such that the contribution from each of these modal patterns in the detected sound signal may be determined. Utilizing the contributions from each modal beam pattern in the detected sound signal, the spatial relationship (e.g., distance and/or orientation/angle) between the audio emission device and the audio capture device may be determined.

29 Claims, 9 Drawing Sheets

EFFICIENT SYSTEM AND METHOD FOR GENERATING AN AUDIO BEACON

FIELD

This non-provisional application claims the benefit of the earlier filing date of U.S. Provisional Application No. 62/105,671 filed Jan. 20, 2015.

FIELD

An embodiment of the invention relates to generating audio beacons that may then used to for example determine the relative location and orientation of an audio emission device. Other embodiments are also described.

BACKGROUND

It is often useful to know the location/orientation of an audio capture device (e.g., a microphone array) relative to an audio emission device (e.g., a loudspeaker array). For example, this location/orientation information may be utilized for optimizing audio-visual content rendered by a computing device. Traditionally, location information may be determined using a set of audio beacons produced by the audio emission device and detected by the audio capture device. For example, an audio emission device may emit a set of beacon beams along with a set of intended/primary beams. The primary beams may represent channels for a piece of sound program content (e.g., a musical composition or a soundtrack for a movie) while the beacon beams are purely intended to be detected by the audio capture device for determining the spatial relationship between the audio capture device and the audio emission device.

However, the approach discussed above suffers from inefficiencies as beacon beams are separate and distinct from primary beams. Accordingly, extra processing overhead must be incurred by the audio emission device to produce these beacon beams.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section.

SUMMARY

An audio emission device and an audio capture device that may respectively emit and capture sound, within a listening area are described. In particular, the audio emission device may include a loudspeaker array, including a set of transducers, for emitting sound and the audio capture device may include one or more microphones (e.g., a standalone microphone, or a set of microphones in a microphone array) for capturing sound in a listening area.

Orthogonal test signals may be added into a set of modal sound patterns produced by the audio emission device, wherein the modal sound patterns are also weighted to produce a set of primary audio beams. The modal sound patterns may be extracted from sounds detected by the audio capture device based on the injected orthogonal test signals, such that the modal beam patterns operate as audio beacons.

In one embodiment, the audio emission device may produce a set of one or more primary audio beams in the listening area. Each of the primary audio beams may be formed by weighting a set of modal beam patterns. In one embodiment, separate orthogonal test signals may be injected into each modal beam pattern. Based on these separate orthogonal test signals, the individual modal beam patterns may be extracted from a detected sound signal produced by the audio capture device such that the contribution from each of these modal patterns in the detected sound signal may be determined. Utilizing the contributions from each modal beam pattern in the detected sound signal, the spatial relationship (e.g., distance and/or orientation/angle) between the audio emission device and the audio capture device may be determined. Accordingly, the modal beam patterns, which are used to generate the primary beams, may also be used as audio beacons.

As discussed above, by injecting orthogonal test signals into modal beam patterns, which are used to generate primary audio beams, the modal beam patterns may function as audio beacons. Accordingly, audio beacons that are separate from the primary audio beams do not need to be generated as instead the modal beam patterns that form the primary audio beams may be used as audio beacons for determining the relative position of the audio emission device relative to the audio capture device.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings. While numerous details are set forth, it is understood that some embodiments of the invention may be practiced without these details. In other instances, well-known circuits, structures, and techniques have not been shown in detail so as not to obscure the understanding of this description.

Figure 1:
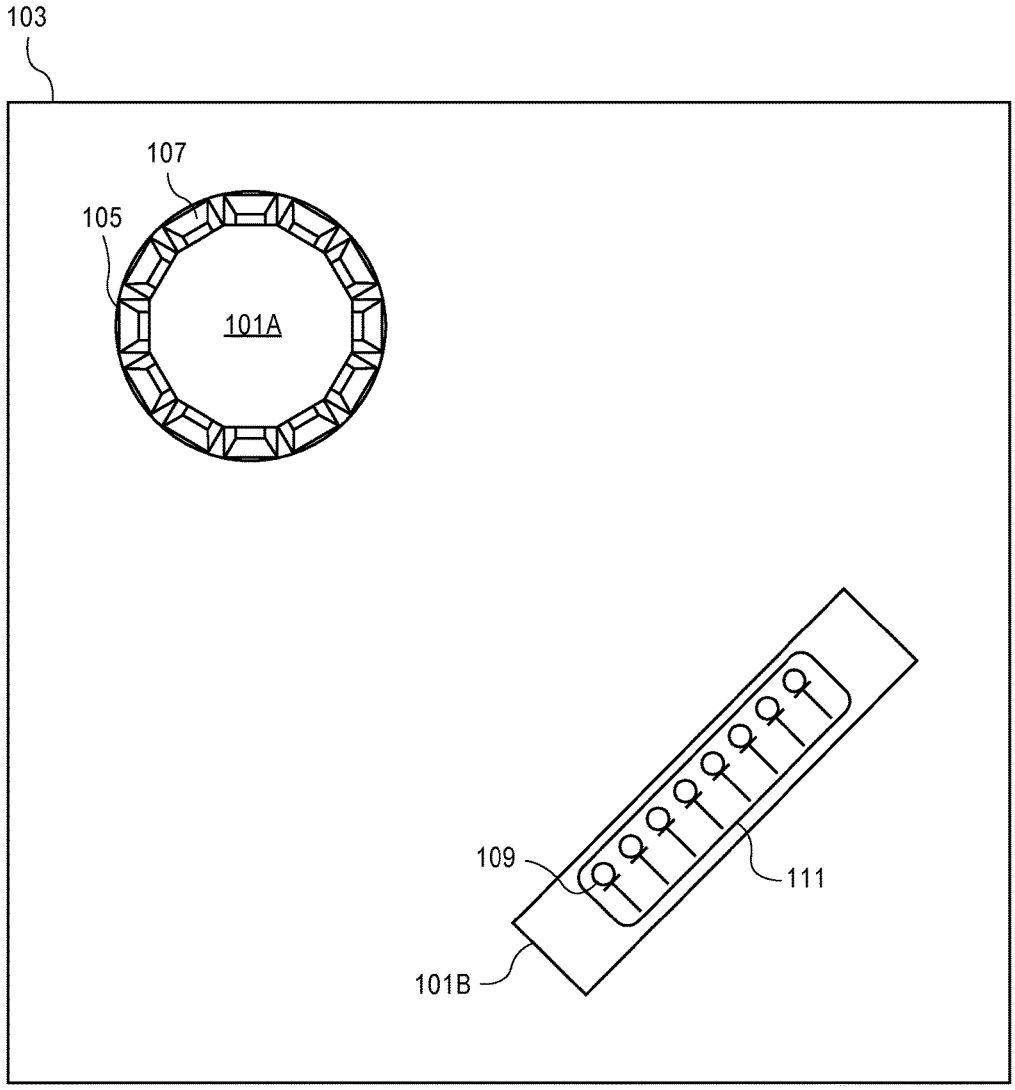
FIG. 1 shows an audio emission device and an audio capture device that may respectively emit and capture sound within a listening area according to one embodiment.

FIG. 1 shows an audio emission device 101A and an audio capture device 101B that may respectively emit and capture sound within a listening area 103. In particular, the audio emission device 101A may include a loudspeaker array 105, including a set of transducers 107, for emitting sound and the audio capture device 101B may include one or more microphones 109 (e.g., a standalone microphone 109, or a set of microphones 109 in a microphone array 111) for capturing sound.

As will be described in greater detail below, the audio emission device 101A may produce a set of primary audio beams in the listening area 103. Each of the primary audio beams may be formed by weighting a set of modal beam patterns. In one embodiment, separate orthogonal test signals may be injected into each modal beam pattern. Based on these separate orthogonal test signals, the individual modal beam patterns may be extracted from a detected sound signal produced by the audio capture device 101B such that the contribution from each of these modal patterns in the detected sound signal may be determined. Utilizing the contributions from each modal beam pattern in the detected sound signal, the spatial relationship (e.g., distance and orientation/angle) between the audio emission device 101A and the audio capture device 101B may be determined. Accordingly, as will be described in greater detail below, the modal beam patterns, which are used to generate the primary beams, may also be used as audio beacons for determining the spatial relationships between the audio emission device 101A and the audio capture device 101B.

As shown in FIG. 1, the audio devices 101A/101B may be located in a listening area 103. The listening area 103 may be a room of any size within a house, a commercial establishment, or any other structure. For example, the listening area 103 may be a home office of a user/listener.

Figure 2:
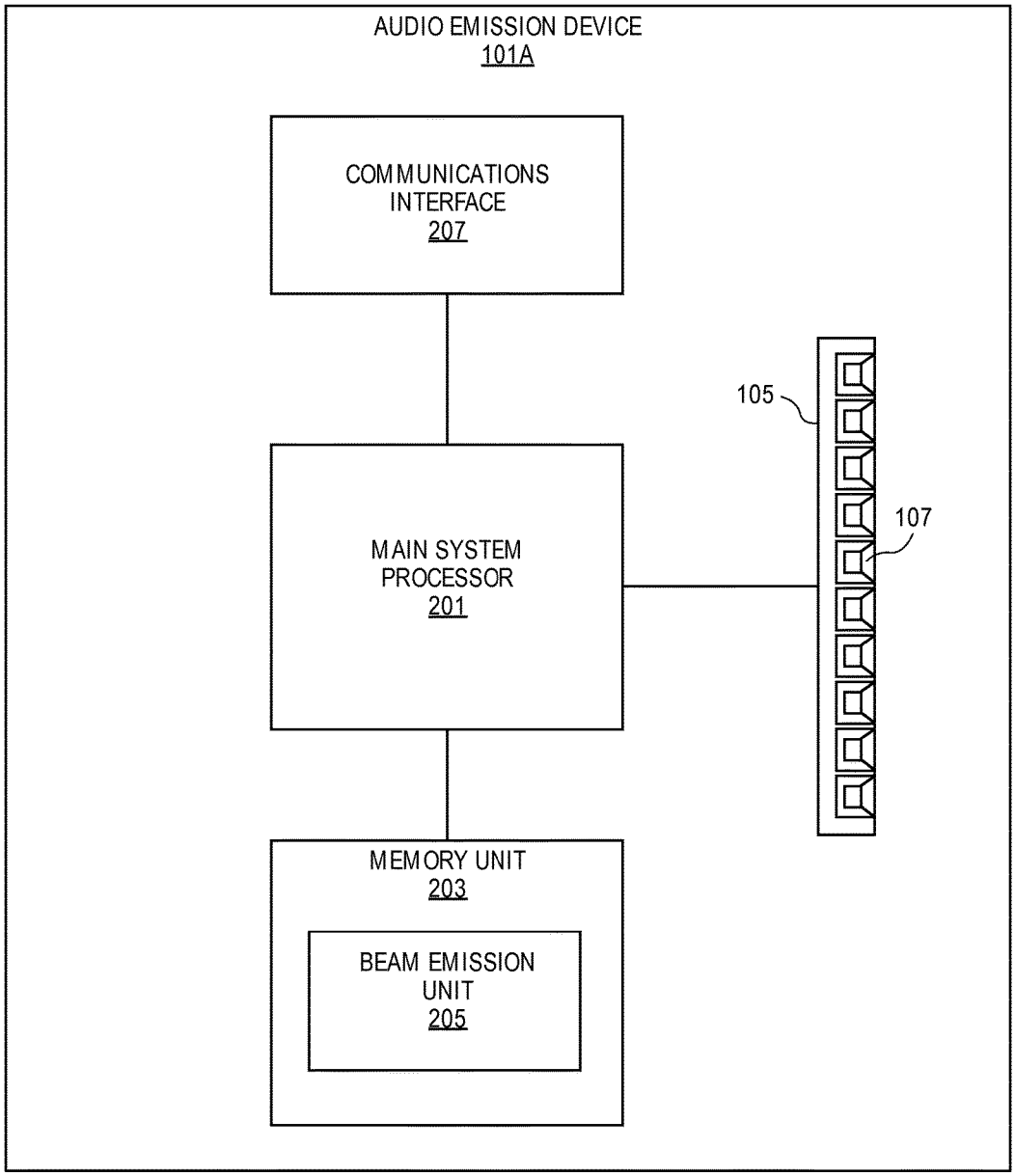
FIG. 2 shows a component diagram of the audio emission device according to one embodiment.

FIG. 2 shows a component diagram of the audio emission device 101A according to one embodiment. The audio emission device 101A may be any computing system that is capable of emitting sound into the listening area 103. For example, the audio emission device 101A may be a laptop computer, a desktop computer, a tablet computer, a video conferencing phone, a set-top box, a multimedia player, a gaming system, and/or a mobile device (e.g., cellular telephone or mobile media player). Each element of the audio emission device 101A shown in FIG. 2 will now be described.

The audio emission device 101A may include a main system processor 201 and a memory unit 203. The processor 201 and memory unit 203 are generically used here to refer to any suitable combination of programmable data processing components and data storage that conduct the operations needed to implement the various functions and operations of the audio emission device 101A. The processor 201 may be a special purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines) while the memory unit 203 may refer to microelectronic, non-volatile random access memory. An operating system may be stored in the memory unit 203, along with application programs specific to the various functions of the audio emission device 101A, which are to be run or executed by the processor 201 to perform the various functions of the audio emission device 101A. For example, the memory unit 203 may include a beam emission unit 205, which in conjunction with other hardware and software elements of the audio emission device 101A, emits a set of modal beam patterns into the listening area 103. As will be described in further detail below, these modal beam patterns (1) may be used for constructing one or more primary beam patterns where each primary beam pattern may be assigned, via beam input parameters, to a separate one or more channels of sound program content (e.g., each input channel of the sound program content may be assigned a separate primary beam, and the primary beam is decomposed into contributions from the modal beams) and (2) may be used as audio beacons for determining the spatial relationship between the audio capture device 101B and the audio emission device 101A.

As noted above, in one embodiment, the audio emission device 101A may include a loudspeaker array 105 for outputting sound into the listening area 103. As shown in FIG. 1 and FIG. 2, the loudspeaker array 105 may include multiple transducers 107 housed in a single cabinet. In the example shown in FIG. 2, the loudspeaker array 105 has ten distinct transducers 107 evenly aligned within a cabinet. Although shown in FIG. 2 as aligned in a flat plane or a straight line, the transducers 107 may be aligned in a curved fashion along an arc. For example, in one embodiment, the transducers 107 may be uniformly integrated on the face of a cylindrical cabinet as shown in the overhead view of the audio emission device 101A in FIG. 1 and the side view of the audio emission device 101A shown in FIG. 3. In other embodiments, different numbers of transducers 107 may be used with uniform or non-uniform spacing and alignment.

The transducers 107 may be any combination of full-range drivers, mid-range drivers, subwoofers, woofers, and tweeters. Each of the transducers 107 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 107 magnetic system interact, generating a mechanical force that causes the coil (and thus, the attached cone) to move back and forth, thereby reproducing sound under the control of the applied electrical audio signal coming from a source.

Each transducer 107 may be individually and separately driven to produce sound in response to a separate and discrete audio signals. By allowing the transducers 107 in the loudspeaker array 105 to be individually and separately driven according to different parameters and settings (including individual drive signal filters, which control delays, amplitude variations, and phase variations across the audio frequency range), the loudspeaker array 105 may produce numerous directivity patterns to simulate or better represent respective channels of sound program content. For example, the transducers 107 in the loudspeaker array 105 may be individually driven to produce a set of modal beam patterns as will be described in greater detail below.

In one embodiment, the audio emission device 101A may include a communications interface 207 for communicating with other components over one or more connections. For example, the communications interface 207 may be capable of communicating using Bluetooth, the IEEE 802.11x suite of standards, IEEE 802.3, cellular Global System for Mobile Communications (GSM) standards, cellular Code Division Multiple Access (CDMA) standards, and/or Long Term Evolution (LTE) standards. In one embodiment, the communications interface 207 facilitates the transmission/reception of video, audio, and/or other pieces of data.

Figure 4:
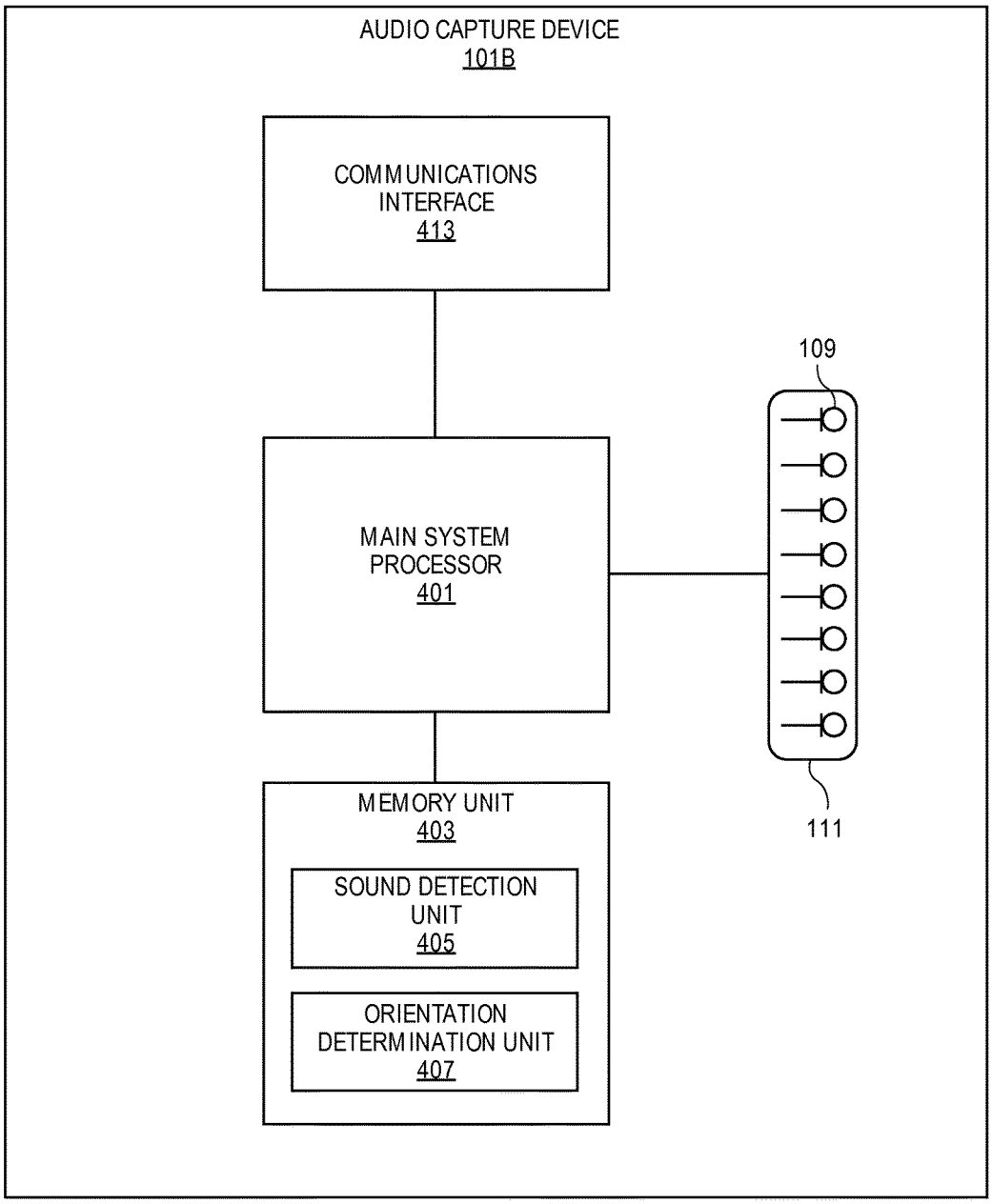
FIG. 4 shows a component diagram of the audio capture device according to one embodiment.

Turning now to FIG. 4, the audio capture device 101B will be described. The audio capture device 101B may be any computing system that is capable of detecting/recording sound in the listening area 103. For example, the audio capture device 101B may be a laptop computer, a desktop computer, a tablet computer, a video conferencing phone, a set-top box, a multimedia player, a gaming system, and/or a mobile device (e.g., cellular telephone or mobile media player).

The audio capture device 101B may include a main system processor 401 and a memory unit 403. Similar to the processor 201 and the memory unit 203, the processor 401 and the memory unit 403 are generically used here to refer to any suitable combination of programmable data processing components and data storage that conduct the operations needed to implement the various functions and operations of the audio capture device 101B. The processor 401 may be a special purpose processor such as an ASIC, a general purpose microprocessor, a FPGA, a digital signal controller, or a set of hardware logic structures (e.g., filters, arithmetic logic units, and dedicated state machines) while the memory unit 403 may refer to microelectronic, non-volatile random access memory. An operating system may be stored in the memory unit 403, along with application programs specific to the various functions of the audio capture device 101B, which are to be run or executed by the processor 401 to perform the various functions of the audio capture device 101B. For example, the memory unit 403 may include a sound detection unit 405 and an orientation determination unit 407. These units 405 and 407, in conjunction with other hardware and software elements of the audio capture device 101B, (1) detect/measure sounds in the listening area 103 (e.g., containing modal beam patterns produced by the audio emission device 101A), (2) extract/separate each of the modal beam patterns represented in a detected sound signal based on detected orthogonal test signals that had been injected into each modal pattern, and (3) determine the orientation of the audio capture device 101B in relation to the audio emission device 101A based on these modal sound patterns.

As noted above, in one embodiment, the audio capture device 101B may include one or more microphones 109. For example, the audio capture device 101B may include multiple microphones 109 arranged in a microphone array 111. Each of the microphones 109 in the audio capture device 101B may sense sounds and convert these sensed sounds into electrical signals. The microphones 109 may be any type of acoustic-to-electric transducer or sensor, including a MicroElectrical-Mechanical System (MEMS) microphone, a piezoelectric microphone, an electret condenser microphone, or a dynamic microphone. The microphones 109 may be used with various filters that can control gain and phase across a range of frequencies in the audible spectrum (including possible use of delays) to provide a range of polar patterns, such as cardioid, omnidirectional, and figure-eight. The generated polar, sound pickup patterns alter the direction and area of sound captured in the vicinity of the audio capture device 101B. In one embodiment, the polar patterns of the microphones 109 may vary continuously over time.

In one embodiment, the audio capture device 101B may include a communications interface 413 for communicating with other components over one or more connections. For example, similar to the communications interface 207, the communications interface 413 may be capable of communicating using Bluetooth, the IEEE 802.11x suite of standards, IEEE 802.3, cellular GSM standards, cellular CDMA standards, and/or LTE standards. In one embodiment, the communications interface 413 facilitates the transmission/reception of video, audio, and/or other pieces of data over one or more connections.

Figure 5:
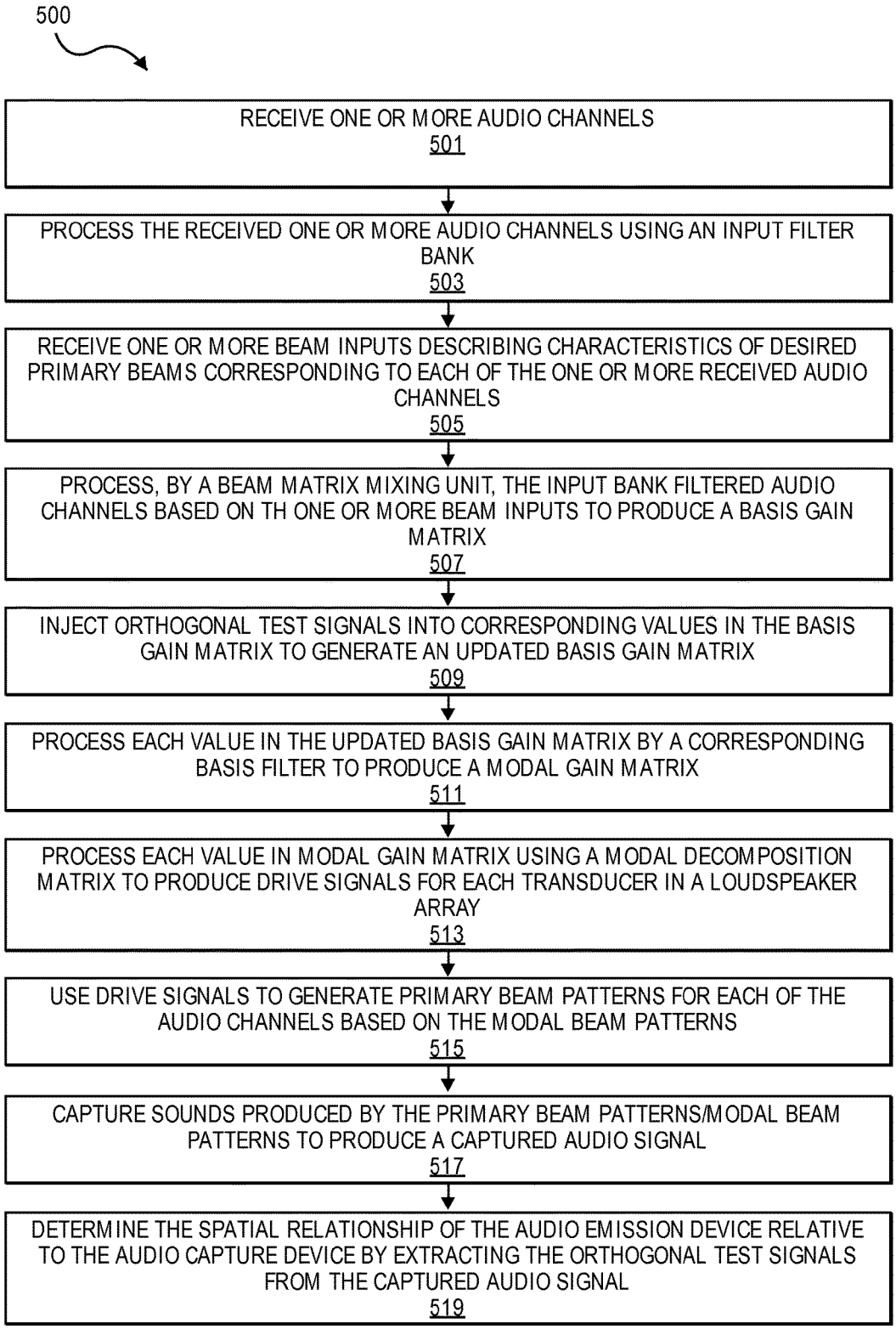
FIG. 5 shows a method according to one embodiment for adding orthogonal test signals into a set of modal beam patterns produced by the audio emission device, wherein the modal beam patterns are weighted to produce a set of primary audio beams.

Turning now to FIG. 5, a method 500 will be described for adding orthogonal test signals into a set of modal beam patterns produced by the audio emission device 101A, wherein the modal beam patterns are also weighted and combined to produce a set of primary audio beams. The modal beam patterns may then be extracted from sounds detected by the audio capture device 101B, based on the injected orthogonal test signals, such that the modal beam patterns operate as audio beacons. The modal beam patterns, which operate as audio beacons based on injected orthogonal test signals, may be used for determining the spatial relationship (e.g., distance and orientation/angle) between the audio emission device 101A and the audio capture device 101B.

Each operation of the method 500 may be performed by one or more components of the audio emission device 101A, the audio capture device 101B, and/or another device. For example, one or more of the beam emission unit 205 of the audio emission device 101A and/or the sound detection unit 405 and the orientation determination unit 407 of the audio capture device 101B may be used for performing the various operations of the method 500. Although the units 205, 405, and 407 are described as software or instructions residing in the memory units 203 and 403, respectively, to be executed by the processors 201, 401, in other embodiments, the actions of the processors 201, 401 executing the units 205, 405, and 407 may be implemented by one or more hardwired logic structures, including digital filters, arithmetic logic units, and dedicated state machines.

The method 500 will be described in relation to the components shown in FIG. 6. In one embodiment, the components shown in FIG. 6 may be integrated within or otherwise represented by one or more of the units 205, 405, and 407.

Although the operations of the method 500 are shown and described in a particular order, in other embodiments the operations of the method 500 may be performed in a different order. For example, one or more of the operations may be performed concurrently or during overlapping time periods. Each operation of the method 500 will now be described below by way of example.

In one embodiment, the method 500 may commence at operation 501 with the receipt of a set of audio signals representing one or more channels for a piece of sound program content. For instance, the audio emission device 101A may receive N channels of audio, as shown in FIG. 6, corresponding to a piece of sound program content (e.g., a musical composition or a soundtrack of a movie). For example, the channels received at operation 501 may correspond to left and right audio channels of a movie soundtrack, where in that case N=2. The audio signals/channels may be received at operation 501 from an external system or device (e.g., an external computer or streaming audio service) via the communications interface 207. In other embodiments, the audio signals/channels may be stored locally on the audio emission device 101A (e.g., stored in the memory unit 203) and retrieved at operation 501.

At operation 503, the one or more audio channels may be processed using one or more filters. For example, as shown in FIG. 6, each of the N audio channels may be processed by a corresponding one of Finite Impulse Response (FIR) filters $\mathbf{601}_1$-$\mathbf{601}_N$ that compose an input filter bank. The FIR filters $\mathbf{601}_1$-$\mathbf{601}_N$ may be selected or configured based on characteristics of the listening area 103 and or characteristics of the channels themselves. For example, the FIR filters $\mathbf{601}_1$-$\mathbf{601}_N$ may process individual frequency components of the N channels to increase or decrease reverberation of the N channels during playback within the listening area 103.

At operation 505, one or more beam inputs may be received describing desired characteristics for N primary beams that will be used for playing back the N channels, respectively. In other words, each primary beam is assigned to play back a separate one of the N input channels. For example, as shown in FIG. 6, the inputs received at operation 505 may include (1) beam type (e.g., a cardioid beam, a hypercardioid beam, a third order beam, etc.) and (2) beam angle (e.g., 0°-360°), for each primary beam. As an example, in the case of an audio program having only two channels (left and right), there may be two primary beams defined by the beam inputs, one for the left channel and one for the right. The beam inputs may be received at operation 505 from any source. For example, the beam inputs may be received from a user indicating their preferences for sound emitted in the listening area 103, or from an audio engineer configuring the audio emission device 101A in a laboratory or manufacturing facility. In other embodiments, the beam inputs may be automatically derived by the audio emission device 101A based on characteristics of the listening area 103 (e.g., size of the listening area 103 and/or the location of walls, ceiling, and floor in the listening area 103) and/or characteristics of the N channels (e.g., type of sound program content represented by the N channels, such as an action movie, or a recording of a musical concert).

The N audio channels may be represented in a matrix or a similar data structure. For example, samples from the N audio channels that have been processed by the FIR filters $\mathbf{601}_1$-$\mathbf{601}_N$ may be represented by the audio sample matrix X:

$$X = \begin{bmatrix} x_1 \\ \vdots \\ x_N \end{bmatrix}$$

In the example audio sample matrix X, each component or value $x_i$ represents a discrete time division of audio channel i. In one embodiment, at operation 507 the audio matrix X may be processed (based on beam inputs received at operation 505) by a beam pattern matrix mixing unit 603, to produce a modal gain matrix. The modal gain matrix may be viewed as representing a number of weighted modal beam patterns. The beam pattern mixing unit 603 may regulate the shape and direction of beam patterns for each of the N audio channels, in view of the beam inputs received at operation 505 which describe desired characteristics for N primary beams. The primary beams as defined by the beam inputs (or beam input patterns) characterize how sound radiates from the transducers 107 in the loudspeaker array 105 and into the listening area 103 (once the transducers 107 are driven by their respective drive signals that have been generated in accordance with the primary beams). For example, a highly directed cardioid beam pattern (having high directivity index, DI) may emit a high degree of sound directly at a listener or another specified area while emitting relatively lower amounts of sound into other areas of the listening area 103, in general. In contrast, a lower directed beam pattern (having low DI, e.g., an omnidirectional beam pattern) may emit a more uniform amount of sound throughout the listening area 103 without special attention to a listener or any specified area.

Figure 7C:
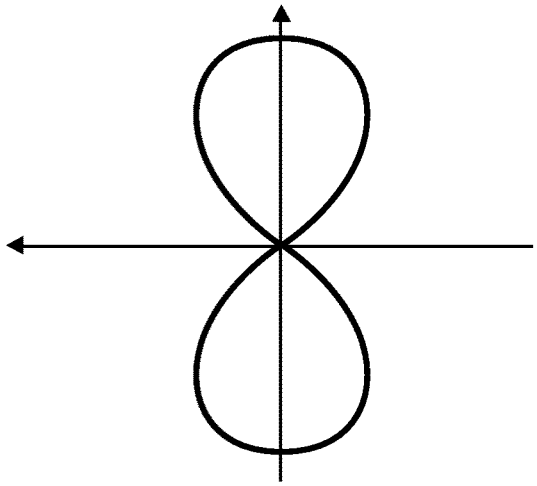
FIG. 7C shows a horizontal dipole modal beam pattern according to one embodiment.
Figure 7B:
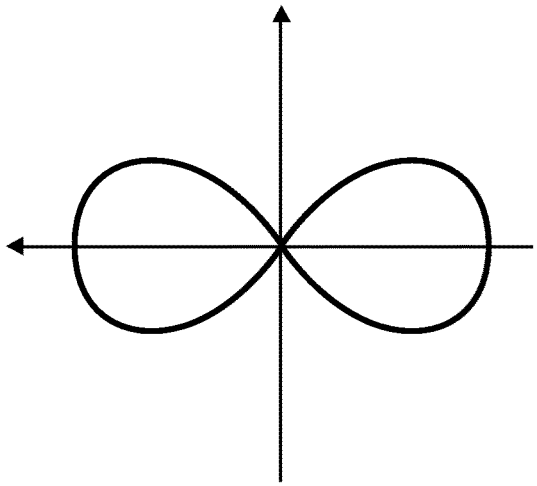
FIG. 7B shows a vertical dipole modal beam pattern according to one embodiment.
Figure 7A:
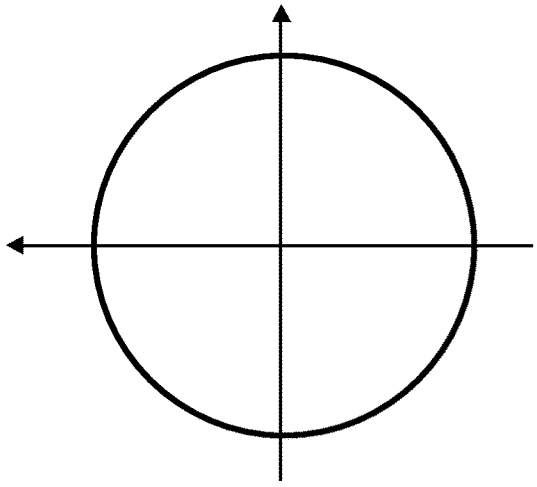
FIG. 7A shows an omnidirectional modal beam pattern according to one embodiment.

For a loudspeaker array 105 with transducers 107 arranged in a circular, cylindrical, spherical, or otherwise curved manner, the radiation of sound may be represented by a set of frequency invariant beam pattern modes or bases. The beam pattern mixing unit 603 may represent or define a desired primary beam pattern in terms of (or as a weighted combination of) a set of two or more predefined, modal beam patterns. For instance, the predefined modal beam patterns may include an omnidirectional pattern (FIG. 7A), a vertical dipole pattern (FIG. 7B), and a horizontal dipole pattern (FIG. 7C). For the omnidirectional pattern, sound is equally radiated in all directions relative to the outputting loudspeaker array 105. For the vertical dipole pattern, sound is radiated in opposite directions along a vertical axis and symmetrical about a horizontal axis. For the horizontal dipole pattern, sound is radiated in opposite directions along the horizontal axis and symmetrical about the vertical axis. Although described as including omnidirectional, vertical dipole, and horizontal dipole modal beam patterns, in other embodiments the predefined modal beam patterns may include additional patterns, including higher order beam patterns. As will be used herein, M modal beam patterns that are each orthogonal to each other may be used. In some embodiments, M may be defined in terms of the beam composition order S as shown below:

$$M=2S+1$$

Figure 8C:
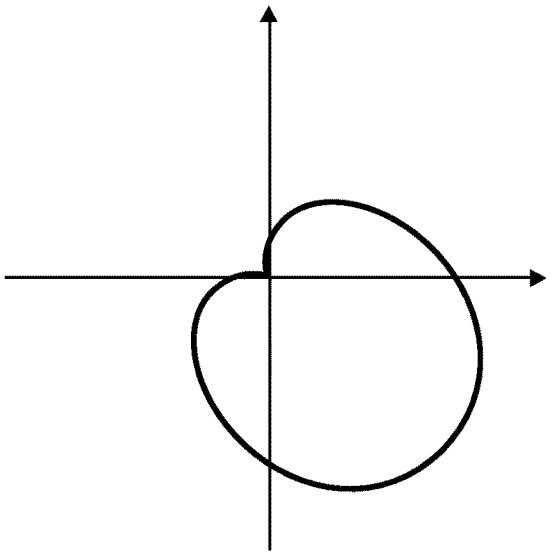
FIG. 8C shows a cardioid beam pattern pointed in a third direction based on a third set of weights applied to a set of modal patterns according to one embodiment.
Figure 8B:
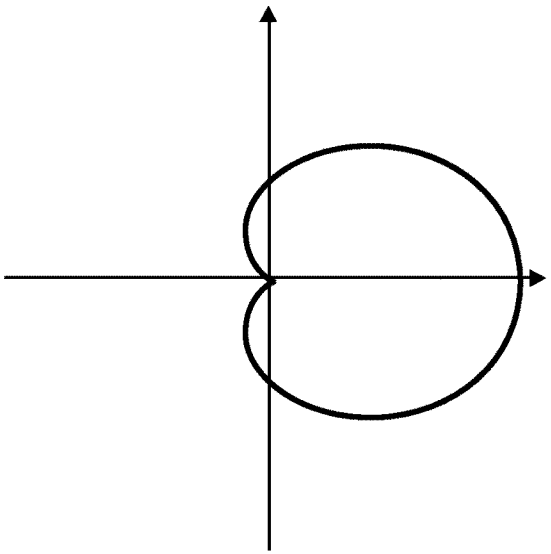
FIG. 8B shows a cardioid beam pattern pointed in a second direction based on a second set of weights applied to a set of modal patterns according to one embodiment.
Figure 8A:
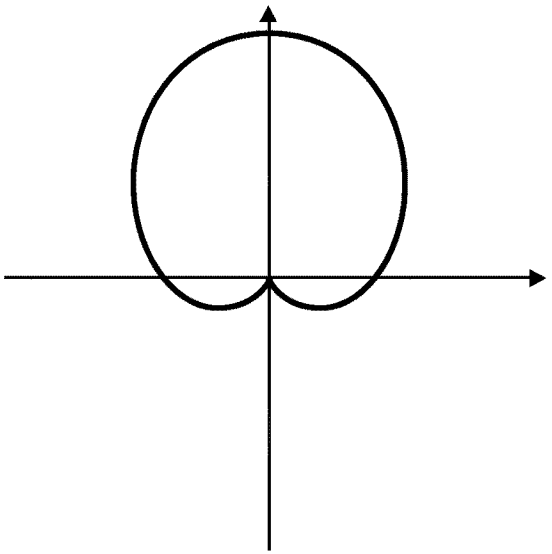
FIG. 8A shows a cardioid beam pattern pointed in a first direction based on a first set of weights applied to a set of modal patterns according to one embodiment.

The beam pattern mixing unit 603 may define a set of weighting values for each of the N audio channels and each of the M predefined modal beam patterns. The weighting values define the amount of each of the N channels to apply to each of the M modal beam patterns, such that a desired, corresponding primary beam pattern, e.g., a separate primary beam for each of the N channels, may be generated by the loudspeaker array 105. In other words, the primary beam pattern is given as a combination of the so-weighted, M modal beam patterns. For example, through the setting of corresponding weighting values, an omnidirectional modal beam pattern may be mixed with a horizontal dipole modal beam pattern to yield a cardioid beam pattern directed at 90° as shown in FIG. 8A. In another example, through the setting of corresponding weighting values, an omnidirectional modal beam pattern may be mixed with a vertical dipole modal beam pattern to yield a cardioid pattern directed at 0° as shown in FIG. 8B. As shown and described, the combination or mixing of the predefined modal beam patterns may produce beam patterns with different shapes and directions for separate audio channels. Accordingly, the beam pattern mixing unit 603 may define a first set of weighting values for a first audio channel such that the loudspeaker array 105 may be driven to produce a first primary beam pattern, while the beam pattern mixing unit 603 may also define a second set of weighting values for a second channel such that the loudspeaker array 105 may be driven to produce a second primary beam pattern.

In one embodiment, the resulting combination of the predefined modal beam patterns may be non-proportional such that more of one modal beam pattern may be used in comparison to another modal beam pattern, to produce a desired beam pattern for an audio channel. In some embodiments, the weighting values defined by the beam pattern mixing unit 603 may be represented by any real numbers. For example, weighting values of $$\frac{1}{\sqrt{2}}$$

may be separately applied to a horizontal dipole modal beam pattern and a vertical dipole modal beam pattern, while a weighting value of one is applied to an omnidirectional modal beam pattern. The mixing of these three variably weighted modal beam patterns may yield a cardioid primary beam pattern directed at 270° as shown in FIG. 8C. Applying different proportions/weights of various modal beam patterns allows the generation of numerous possible primary beam patterns, far in excess of the number of direct combinations of the predefined modal beam patterns.

As described above, different weighting values may be used to apply different levels of each predefined modal beam pattern to generate a desired primary beam pattern, for a corresponding audio channel. In one embodiment, the beam pattern mixing unit 603 may use a beam pattern matrix Z that defines a primary beam pattern for each of the N audio channels in terms of weighting values applied to the predefined M modal beam patterns. For example, each entry a in the beam pattern matrix Z may correspond to a real number weighting value for a predefined modal beam pattern and a corresponding audio channel. For a set of M modal patterns and N audio channels, the beam pattern matrix $Z_{M,N}$ may be represented as:

$$Z_{M,N} = \begin{bmatrix} \alpha_{1,1} & \cdots & \alpha_{1,N} \\ \vdots & \ddots & \vdots \\ \alpha_{M,1} & \cdots & \alpha_{M,N} \end{bmatrix}$$

As previously described, each of the weighting values α represents the level or degree a predefined modal beam pattern is to be applied to a corresponding audio channel. In the above example matrix $Z_{M,N}$, each column represents the level or degree to which a respective one of the M predefined modal beam patterns will be applied, to a corresponding audio channel in the N received/retrieved audio channels. Each of the weighting values α may be based on the primary beam inputs received at operation 505.

The beam pattern mixing unit 603 may apply the beam pattern matrix Z to the N audio channels by multiplying the audio channel matrix X with the beam pattern matrix Z as shown below:

$$\begin{bmatrix} \alpha_{1,1} & \cdots & \alpha_{1,N} \\ \vdots & \ddots & \vdots \\ \alpha_{M,1} & \cdots & \alpha_{M,N} \end{bmatrix} \times \begin{bmatrix} x_1 \\ \vdots \\ x_N \end{bmatrix} = \begin{bmatrix} y_1 \\ \vdots \\ y_M \end{bmatrix}$$

Multiplication of the beam pattern matrix Z and the audio channel matrix X yields a basis or modal gain matrix Y, as shown in the above equation. This multiplication may be repeatedly performed for each sample period of the N audio channels (each sample period having a new matrix $X_N$) to yield a new modal gain matrix Y, for each sample period. Each component or value y in the modal gain matrix Y represents gains corresponding to the N audio channels that will be transmitted to corresponding modal filters $\mathbf{607}_1$-$\mathbf{607}_M$, each of which represent a corresponding predefined modal beam pattern—see FIG. 6.

In one embodiment, prior to feeding the modal gain matrix Y to the modal filters $\mathbf{607}_1$-$\mathbf{607}_M$, operation 509 may mix orthogonal test signals into each modal beam pattern within the modal gain matrix Y, to generate an updated basis or modal gain matrix Y'. In some embodiments, the orthogonal test signals may be pseudorandom noise sequences, satisfying one or more of the standard tests for statistical randomness. For example, the orthogonal test signals may be generated using a linear shift register. In this embodiment, taps of the shift register would be set differently for each of the M modal beam patterns, thus ensuring that the M generated test signals are orthogonal to each other. In other embodiments, the orthogonal test signals may be highly or nearly orthogonal such that the dot product of each set of two orthogonal test signals is close to zero (i.e., within a threshold or tolerance amount from zero). There may be M orthogonal test signals, which may be binary sequences, where, as noted above, M is the number of modal beam patterns. The orthogonal test signals may be variable in duration or length (e.g., each may be 100 milliseconds to 3 seconds in duration).

Mixing may be performed at operation 509 using a mixer. The mixer 605 may be composed of any set of elements that combine two or more signals. In one embodiment, the mixer 605 may include a resistor network, buffer amplifiers, transistors, diodes, and/or other related components. In one embodiment, the modal/basis gain matrix Y may be combined with a matrix P of orthogonal test signals $p_1, p_2, \ldots p_m$ (or $PSN_1, PSN_2, \ldots PSN_M$ as depicted in FIG. 6 where PSN is an abbreviation for pseudo-random noise) as shown below, to generate an updated modal/basis gain matrix Y':

$$\begin{bmatrix} y_1 \\ \vdots \\ y_M \end{bmatrix} + \begin{bmatrix} p_1 \\ \vdots \\ p_M \end{bmatrix} = \begin{bmatrix} y'_1 \\ \vdots \\ y'_M \end{bmatrix}$$

In the equation above, each of the modal gains $y_i$ may be combined with corresponding orthogonal test signals $p_i$ to yield an updated modal gain value $y_i'$ (forming a matrix Y' that is composed of updated modal gain values.)

As noted above, following mixing of an orthogonal test signal with each of the M modal gains at operation 509, the updated modal gain matrix Y' may be processed by corresponding modal/basis filters 607 at operation 511, to produce a filtered modal/basis gain matrix. In one embodiment, each of the M modal filters 607 may compensate for radiation inefficiencies of sound at low frequencies, for each corresponding modal beam pattern. In particular, higher order modal beam patterns (and/or modal beam patterns with higher DI) may be more difficult to accurately produce at lower frequencies, and requiring stronger drive signals (e.g., high voltage) to produce. Specifically, lower frequency sounds tend to diffuse into the listening area 103 instead of forming directed patterns. To compensate for these inefficiencies, the M modal filters 607 may be linear digital filters that set their frequency responses to provide the needed boost at low frequencies. For instance, a modal filter $\mathbf{607}_i$ for a particular predefined modal beam pattern i may boost the output power of its input signal below a roll-off or cut-off frequency for the modal beam pattern i (e.g., the frequency at which the power of the signal for the modal beam pattern has dropped by one-half). Compensating for inefficiencies in modal beam patterns allows the modal beam patterns to be effectively and efficiently used at lower frequencies to produce more complex beam patterns (e.g., higher order patterns and/or beam patterns with higher directivity indices). In some embodiments, these M modal filters 607 may be affected by the diameter of the cabinet of the loudspeaker array 105. In particular, the farthest distance between two of the transducers 107, e.g., two transducers that are on opposing sides of the cabinet, which may be defined by a diameter of a circular cabinet, may affect the efficiencies and shape of sound produced by sets of transducers 107. Thus, the settings for a particular modal filter 607*i* may be adjusted according to the dimensions of the cabinet.

Figure 6:
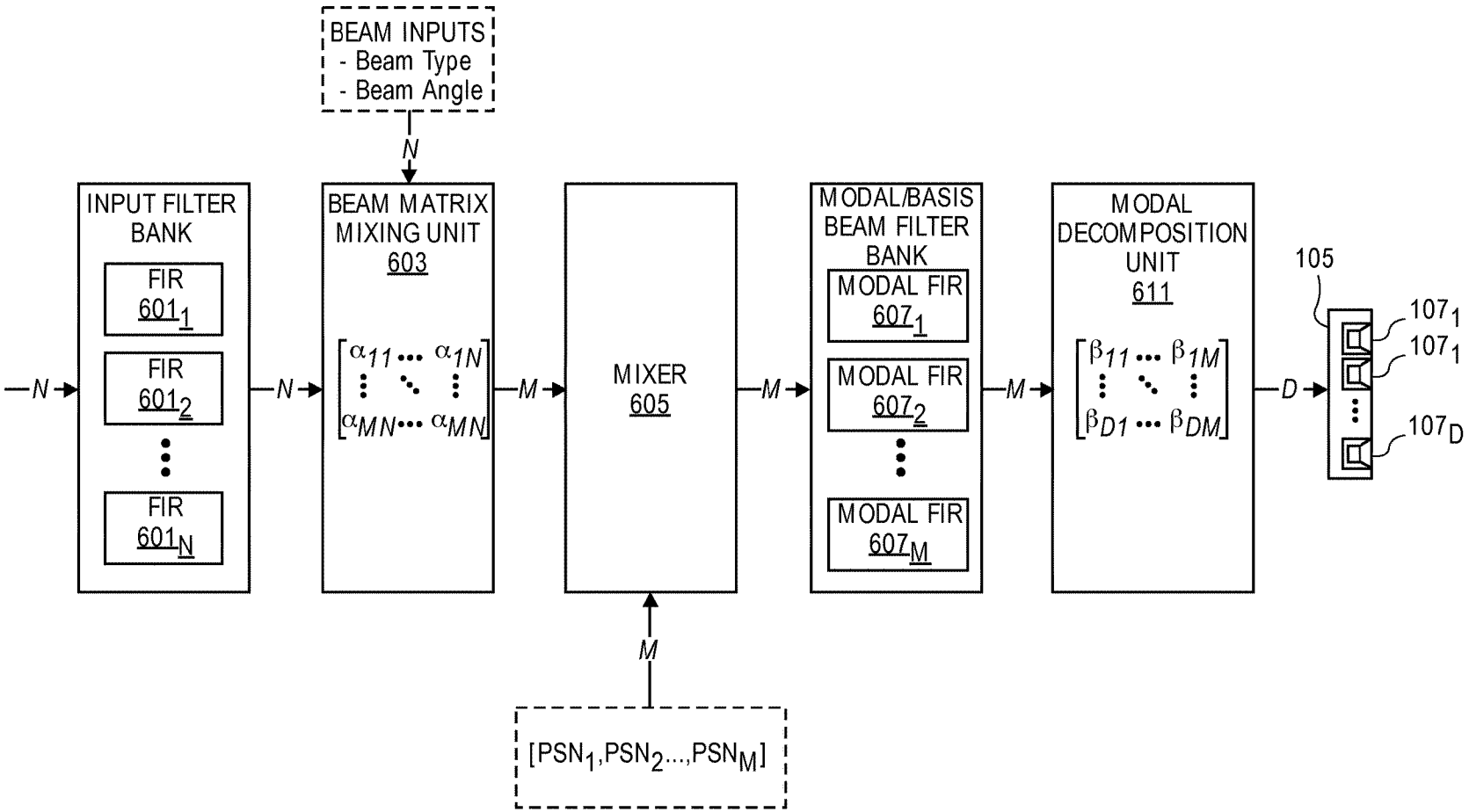
FIG. 6 shows digital signal processing components used for adding orthogonal test signals into a set of modal beam patterns that are produced by the audio emission device, wherein the modal beam patterns are weighted to produce a set of primary audio beams.

Still referring to FIG. 6, in one embodiment, the modal filters 607 may produce a filtered basis/modal gain matrix that is also referred to here as a matrix Q of modal amplitudes. The matrix Q may be processed by a modal decomposition unit 611, also referring now to operation 513 in FIG. 5, to produce the drive signals for each transducer 107 in the array 105. The modal amplitude matrix Q may be represented as shown below:

$$Q = \begin{bmatrix} q_1 \\ \vdots \\ q_M \end{bmatrix}$$

The modal decomposition unit 611 may determine how each transducer 107 in the loudspeaker array 105 is to be driven, so that the array 105 as a whole produces each of the primary beams. For example, to produce an omnidirectional modal beam pattern, each of the transducers 107 in the loudspeaker array 105 may be driven using the same driving signal (no relative delays, no relative gain differences). In contrast, a dipole modal beam pattern may require driving different sets of transducers 107 with driving signals that have varied weights (to achieve relative delay and/or relative gain differences.) In one embodiment, the modal decomposition unit 611 may include a modal decomposition matrix T that includes real numbers defining weights for each of the M modal beam patterns, that correspond to each of the D transducers 107 in the loudspeaker array 105. The modal decomposition matrix may be a matrix of real numbers representing assignment levels for each modal beam pattern to each transducer in the loudspeaker array, such that the transducers in the loudspeaker array produce each of the predefined modal patterns based on the weights represented in the beam pattern mixing matrix. The modal decomposition matrix T may be represented as:

$$T_{D,M} = \begin{bmatrix} \beta_{1,1} & \cdots & \beta_{1,M} \\ \vdots & \ddots & \vdots \\ \beta_{D,1} & \cdots & \beta_{D,M} \end{bmatrix}$$

In this example matrix T, each column represents a predefined modal beam pattern, while each row represents a transducer 107 in the loudspeaker array 105. Each of the weights βi,j in the modal decomposition matrix T may be applied to the modal amplitudes q in the modal amplitude matrix Q to create drive signals for each transducer 107 in the loudspeaker array 105. For example, the below sample modal decomposition matrix T defines weighting values for four modal beam patterns (four columns in the matrix) and eight transducers 107 (eight rows in the matrix) in a loudspeaker array 105:

$$\begin{bmatrix} 1 & 0 & 1 & 1 \\ \frac{1}{2} & 1 & 0 & 1 \\ 0 & 0 & -1 & 1 \\ -\frac{1}{2} & -1 & 0 & 1 \\ -1 & 0 & 1 & 1 \\ -\frac{1}{2} & 1 & 0 & 1 \\ 0 & 0 & -1 & 1 \\ \frac{1}{2} & -1 & 0 & 1 \end{bmatrix}$$

Figure 3:
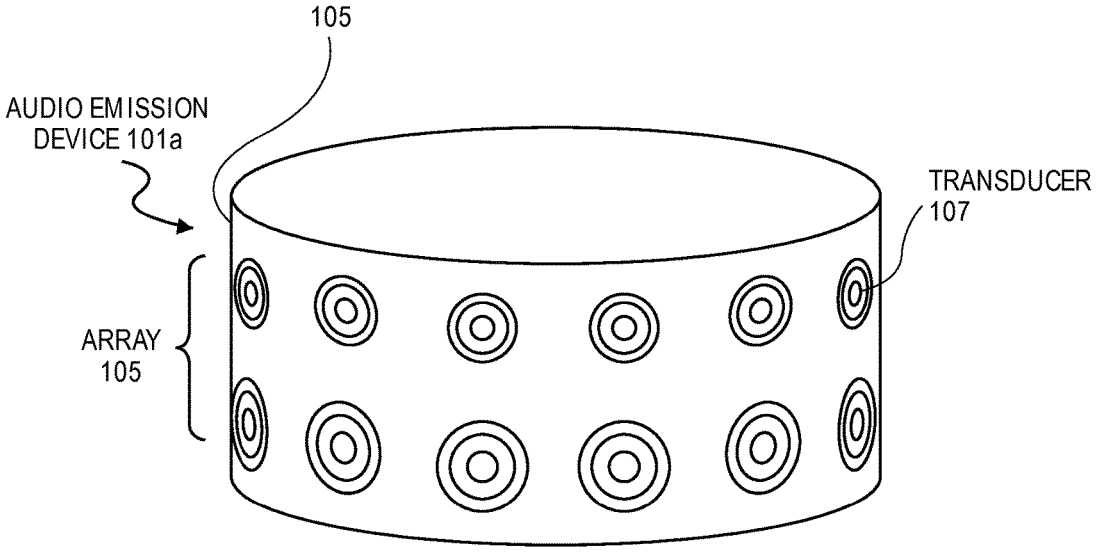
FIG. 3 shows a side perspective view of the audio emission device according to one embodiment.

The weights β may be chosen to represent the arrangement of the transducers 107 in the loudspeaker array 105. For example, as shown in FIGS. 1 and 3, the transducers 107 may be arranged in a circle around the cylindrical cabinet of the loudspeaker array 105. To accommodate for the positioning of the transducers 107 in a circle, the weights β that are in each column of the matrix may correspond to different phases of a sine or a cosine curve. In one embodiment, the weights β are set during configuration of the audio emission device 101A. In another embodiment, the manufacturer of the audio emission device 101A may preset the weighting values β for one or more different types of listening environments 103.

To generate a set of driving signals for the transducer 107, respectively, the modal amplitude matrix Q received from the modal filters 607 may be multiplied with the modal decomposition matrix T as shown below:

$$\begin{bmatrix} \beta_{1,1} & \cdots & \beta_{1,M} \\ \vdots & \ddots & \vdots \\ \beta_{D,1} & \cdots & \beta_{D,M} \end{bmatrix} \times \begin{bmatrix} q_1 \\ \vdots \\ q_M \end{bmatrix} = \begin{bmatrix} r_1 \\ \vdots \\ r_D \end{bmatrix}$$

The resulting driving signal matrix R includes a separate driving signal $r_i$ for each of the D transducers 107. By multiplying the modal amplitude matrix Q with the modal decomposition matrix T, each of the driving signals $r_i$ includes a weighted component of each predefined modal beam pattern. In this manner, the transducers 107 may be driven to produce the desired N primary beams, for the N audio channels, by using appropriate components from each of the predefined, M modal beam patterns. And since the modal beam patterns also include respective orthogonal test signals, the modal beam patterns here may be used as audio beacons, as will be described further below.

At operation 515, the driving signals r produced by the modal decomposition unit 611 may be output to power amplifiers for driving corresponding transducers 107 in the loudspeaker array 105. Accordingly, the loudspeaker array 105 produces in the listening area 103 the primary beam patterns, which have been defined by the beam inputs received at operation 505, and in part as a result of the relative weights that were applied to the modal beam patterns by the decomposition unit 611. Since each of the modal beam patterns effectively included injected orthogonal test signals, these orthogonal test signals are also projected into the listening area 103 (by the audio emission device 101A).

Figure 9:
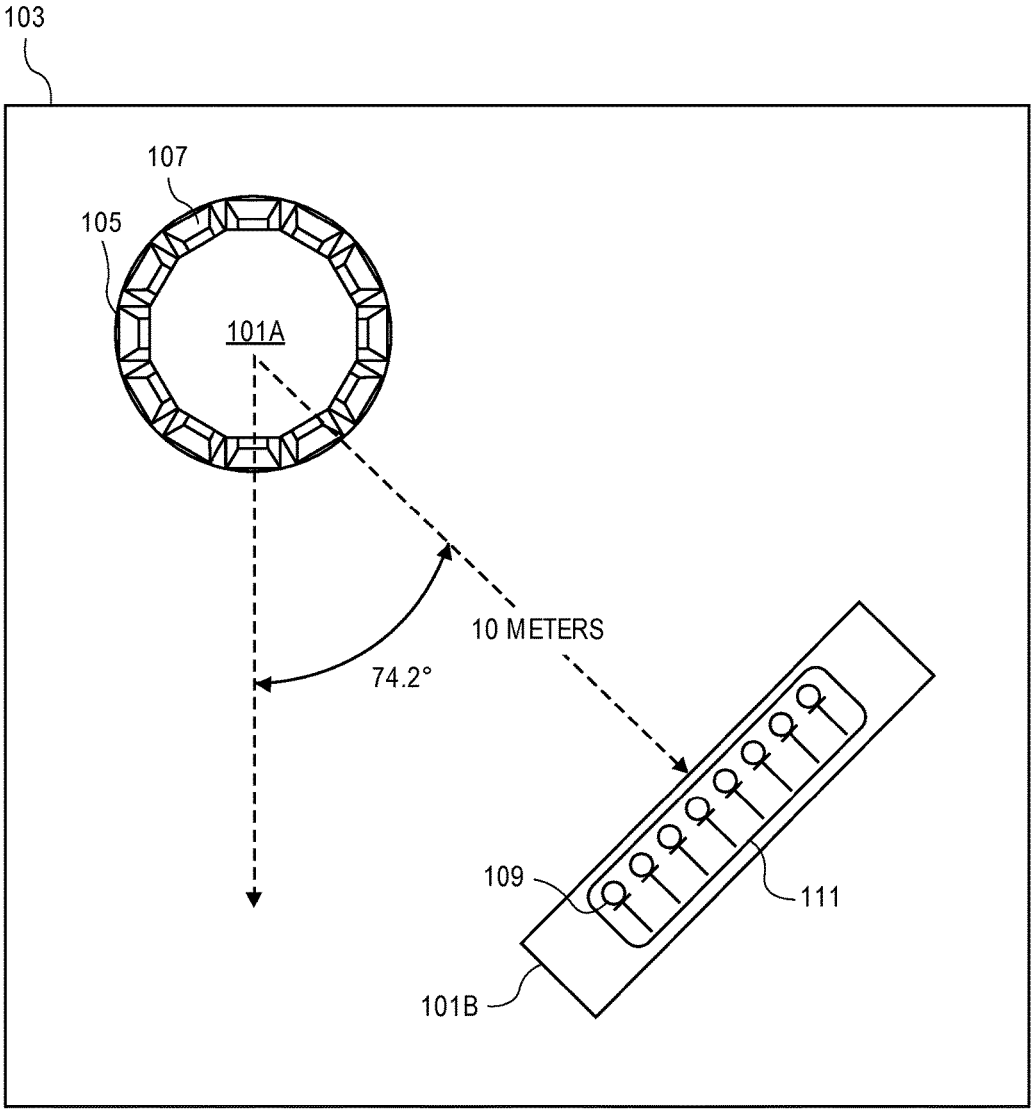
FIG. 9 shows a determined angle and distance between the audio emission device and the audio capture device according to one embodiment.

At operation 517, the audio capture device 101B may capture the sound that is being produced by the audio emission device 101A (within the listening area 103), using the sound detection unit 405 and the microphones 109—see FIG. 4. The captured sound, represented in a captured audio signal from one or more of the microphones 109, may include sounds representing each of the modal beam patterns, which compose the primary beams. At operation 519, the captured audio signal may be analyzed to determine the relative intensities of each of the orthogonal test signals (e.g., relative to each other or to an expected, predetermined reference level), in the captured audio signal. The relative intensities of each of the orthogonal test signals in the captured audio signal may be used by the orientation determination unit 407 to determine the positioning/orientation of the audio capture device 101B relative to the audio emission device 101A at operation 519. For example, based on a knowledge of the modal beam patterns used by the audio emission device 101A, operation 519 may determine the rotation (angular orientation) and distance of the audio capture device 101B relative to the audio emission device 101A as shown in FIG. 9.

As discussed above, by injecting orthogonal test signals into a process in which modal beam patterns are used to generate primary audio beams, the modal beam patterns may effectively function as audio beacons. In particular, the orthogonal test signals may be detected by the audio capture device 101B and analyzed to determine the relative position of the audio emission device 101A relative to the audio capture device 101B. Accordingly, audio beacons that are separate from the primary audio beams do not need to be generated, as instead the modal beam patterns that form the primary audio beams may be used as audio beacons, for determining the relative position of the audio emission device 101A relative to the audio capture device 101B.

As explained above, an embodiment of the invention may be an article of manufacture in which a machine-readable medium (such as microelectronic memory) has stored thereon instructions which program one or more data processing components (generically referred to here as a "processor") to perform the operations described above including the digital signal processing tasks of the audio emission device recited in operations 507, 509, 511, and 513 of FIG. 5. In other embodiments, some of these operations might be performed by specific hardware components that contain hardwired logic circuit blocks (e.g., dedicated digital filter blocks, state machines, and other combinational or sequential logic circuits). Those operations might alternatively be performed by any combination of programmed data processing components and fixed, hardwired logic circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for determining the spatial relationship between an audio emission device and an audio capture device, comprising:

applying weights to a plurality of predefined modal beam patterns, for each audio channel in a plurality of audio channels, to produce a modal gain matrix representing a plurality of weighted modal beam patterns, wherein the modal gain matrix represents the shapes of a plurality of primary beams in terms of the plurality of predefined modal beam patterns;

injecting a separate orthogonal test signal into each of the plurality of weighted modal beam patterns represented by the modal gain matrix;

filtering the modal gain matrix that includes the injected orthogonal test signals, by corresponding modal beam pattern filters;

driving a loudspeaker array in the audio emission device to produce the primary beams using the filtered modal gain matrix that includes the injected orthogonal test signals;

receiving a captured sound signal corresponding to the primary beams detected by the audio capture device; and determining the spatial relationship of the audio capture device relative to the audio emission device based on intensities of the orthogonal test signals as extracted from the captured sound signal.

2. The method of claim 1, further comprising:

processing the filtered modal gain matrix that includes the injected orthogonal test signals using a modal decomposition matrix to produce a set of drive signals used to drive individual transducers in the loudspeaker array to generate the primary beams in terms of the plurality of predefined modal beam patterns, wherein the modal decomposition matrix is a matrix of real numbers representing assignment levels for each predefined modal beam pattern to each transducer in the loudspeaker array such that the loudspeaker array produces beams based on the weights applied to the plurality of predefined modal beam patterns.

3. The method of claim 1, wherein each modal beam pattern filter corresponds to a separate modal beam pattern in the plurality of predefined modal beam patterns, and each modal beam pattern filter boosts a power level of a corresponding modal gain in the modal gain matrix below a roll-off frequency associated with a corresponding modal beam pattern.

4. The method of claim 1, wherein the modal gain matrix includes individual real number coefficients for each of the predefined modal beam patterns.

5. The method of claim 1, wherein the orthogonal test signals satisfy one or more of tests for statistical randomness.

6. The method of claim 1, wherein the plurality of predefined modal beam patterns include a vertical dipole pattern, a horizontal dipole pattern, and an omnidirectional pattern.

7. A system, comprising:

an audio emission device, including:

a matrix mixing unit to apply weights to a plurality of predefined modal beam patterns, for each audio channel in a plurality of audio channels, to produce a modal gain matrix representing a plurality of weighted modal beam patterns, wherein the modal gain matrix represents the shapes of a plurality of primary beams in terms of the predefined modal beam patterns;

a mixer to inject separate pseudorandom noise sequences into each weighted modal beam pattern represented by the modal gain matrix;

a plurality of modal beam pattern filters to filter the modal gain matrix that includes the injected pseudorandom noise sequences;

a loudspeaker array to produce the primary beams using the filtered modal gain matrix that includes the injected pseudorandom noise sequences; and an audio capture device, including:

a plurality of microphones to detect sound corresponding to the primary beams, and generate a detected sound signal; and an orientation determination unit to determine the spatial relationship of the audio capture device relative to the audio emission device based on intensities of the pseudorandom noise sequences extracted from the detected sound signal.

8. The system of claim 7, wherein the audio emission device further includes:

a modal decomposition unit to process the filtered modal gain matrix that includes the injected pseudorandom noise sequences using a modal decomposition matrix to produce a set of drive signals used to drive individual transducers in the loudspeaker array to generate the primary beams in terms of the predefined modal beam patterns, wherein the modal decomposition matrix is a matrix of real numbers representing assignment levels for each predefined modal beam pattern to each transducer in the loudspeaker array such that the transducers in the loudspeaker array produce each of the predefined modal patterns based on the applied weights.

9. The system of claim 7, wherein each modal beam pattern filter corresponds to a separate predefined modal beam pattern in the plurality of predefined modal beam patterns and each modal beam pattern filter boosts a power level of a corresponding modal gain in the modal gain matrix below a roll-off frequency associated with a corresponding predefined modal beam pattern.

10. The system of claim 7, wherein the modal gain matrix includes individual real number coefficients for each of the predefined modal beam patterns.

11. The system of claim 7, wherein the pseudorandom noise sequences satisfy one or more tests for statistical randomness.

12. The system of claim 7, wherein the predefined modal beam patterns include a vertical dipole pattern, a horizontal dipole pattern, and an omnidirectional pattern.

13. An article of manufacture, comprising:

a non-transitory machine-readable storage medium that stores instructions which, when executed by a processor in a computing device, apply weights to a plurality of modal beam patterns for each audio channel in a set of audio channels to produce a modal gain matrix representing weighted modal beam patterns, wherein the modal gain matrix represents the shape of a primary beam in terms of the modal beam patterns, wherein the primary beam is to contain content from one or more of the audio channels;

inject separate orthogonal test signals into each modal beam pattern represented by the modal gain matrix;

filter the modal gain matrix that includes the injected orthogonal test signals by corresponding modal beam pattern filters;

drive a loudspeaker array in an audio emission device to produce the primary beam using the filtered modal gain matrix that includes the injected orthogonal test signals;

generate a captured audio signal that corresponds to the primary beam based on sound captured by an audio capture device; and determine the spatial relationship of the audio capture device relative to the audio emission device based on intensities of the orthogonal test signals extracted from the captured audio signal.

14. The article of manufacture of claim 13, wherein the non-transitory machine-readable storage medium includes further instruction that when executed by the processor:

process the filtered modal gain matrix that includes the injected orthogonal test signals using a modal decomposition matrix to produce a set of drive signals used to drive individual transducers in the loudspeaker array to generate the primary beam in terms of the modal beam patterns, wherein the modal decomposition matrix is a matrix of real numbers representing assignment levels for each modal beam pattern to each transducer in the loudspeaker array such that the transducers in the loudspeaker array produce each of the modal beam patterns based on the applied weights.

15. The article of manufacture of claim 13, wherein each modal beam pattern filter corresponds to a separate modal beam pattern in the plurality of modal beam patterns and each modal beam pattern filter boosts a power level of a corresponding modal gain in the modal gain matrix below a roll-off frequency associated with a corresponding modal beam pattern.

16. The article of manufacture of claim 13, wherein the modal gain matrix includes individual real number coefficients for each of the modal beam patterns.

17. The article of manufacture of claim 13, wherein the orthogonal test signals satisfy one or more tests for statistical randomness.

18. An audio emission device, comprising:

a matrix mixing unit to apply weights to a plurality of predefined modal beam patterns, for each audio channel in a plurality of audio channels, to produce a modal gain matrix representing a plurality of weighted modal beam patterns, wherein the modal gain matrix represents the shapes of a plurality of primary beams in terms of the predefined modal beam patterns;

a mixer to inject separate pseudorandom noise sequences into each weighted modal beam pattern represented by the modal gain matrix;

a plurality of modal beam pattern filters to filter the modal gain matrix that includes the injected pseudorandom noise sequences;

a loudspeaker array to produce the primary beams using the filtered modal gain matrix that includes the injected pseudorandom noise sequences;

a communications interface to receive a detected sound signal generated by an audio capture device configured to detect sound corresponding to the primary beams using a plurality of microphones; and an orientation determination unit to determine the spatial relationship of the audio capture device relative to the audio emission device based on intensities of the pseudorandom noise sequences extracted from the detected sound signal.

19. The audio emission device of claim 18, further including:

a modal decomposition unit to process the filtered modal gain matrix that includes the injected pseudorandom noise sequences using a modal decomposition matrix to produce a set of drive signals used to drive individual transducers in the loudspeaker array to generate the primary beams in terms of the predefined modal beam patterns, wherein the modal decomposition matrix is a matrix of real numbers representing assignment levels for each predefined modal beam pattern to each transducer in the loudspeaker array such that the transducers in the loudspeaker array produce each of the predefined modal patterns based on the applied weights.

20. The audio emission device of claim 18, wherein each modal beam pattern filter corresponds to a separate predefined modal beam pattern in the plurality of predefined modal beam patterns and each modal beam pattern filter boosts a power level of a corresponding modal gain in the modal gain matrix below a roll-off frequency associated with a corresponding predefined modal beam pattern.

21. The audio emission device of claim 18, wherein the modal gain matrix includes individual real number coefficients for each of the predefined modal beam patterns.

22. The audio emission device of claim 18, wherein the pseudorandom noise sequences satisfy one or more tests for statistical randomness.

23. The audio emission device of claim 18, wherein the predefined modal beam patterns include a vertical dipole pattern, a horizontal dipole pattern, and an omnidirectional pattern.

24. An audio capture device, comprising:

a matrix mixing unit to apply weights to a plurality of predefined modal beam patterns, for each audio channel in a plurality of audio channels, to produce a modal gain matrix representing a plurality of weighted modal beam patterns, wherein the modal gain matrix represents the shapes of a plurality of primary beams in terms of the predefined modal beam patterns;

a mixer to inject separate pseudorandom noise sequences into each weighted modal beam pattern represented by the modal gain matrix;

a plurality of modal beam pattern filters to filter the modal gain matrix that includes the injected pseudorandom noise sequences;

a communications interface to transmit the primary beams to an audio emission device configured to produce the primary beams with a loudspeaker array, the primary beams using the filtered modal gain matrix that includes the injected pseudorandom noise sequences; a plurality of microphones to detect sound corresponding to the primary beams, and generate a detected sound signal; and an orientation determination unit to determine the spatial relationship of the audio capture device relative to the audio emission device based on intensities of the pseudorandom noise sequences extracted from the detected sound signal.

25. The audio capture device of claim 24, further including:

a modal decomposition unit to process the filtered modal gain matrix that includes the injected pseudorandom noise sequences using a modal decomposition matrix to produce a set of drive signals used to drive individual transducers in the loudspeaker array to generate the primary beams in terms of the predefined modal beam patterns, wherein the modal decomposition matrix is a matrix of real numbers representing assignment levels for each predefined modal beam pattern to each transducer in the loudspeaker array such that the transducers in the loudspeaker array produce each of the predefined modal patterns based on the applied weights.

26. The audio capture device of claim 24, wherein each modal beam pattern filter corresponds to a separate predefined modal beam pattern in the plurality of predefined modal beam patterns and each modal beam pattern filter boosts a power level of a corresponding modal gain in the modal gain matrix below a roll-off frequency associated with a corresponding predefined modal beam pattern.

27. The audio capture device of claim 24, wherein the modal gain matrix includes individual real number coefficients for each of the predefined modal beam patterns.

28. The audio capture device of claim 24, wherein the pseudorandom noise sequences satisfy one or more tests for statistical randomness.

29. The audio capture device of claim 24, wherein the predefined modal beam patterns include a vertical dipole pattern, a horizontal dipole pattern, and an omnidirectional pattern.

* * * * *